US005623800A

United States Patent [19]

Shinkosky

[11] Patent Number: 5,623,800

[45] Date of Patent: Apr. 29, 1997

[54] PANEL SYSTEM

[75] Inventor: George Shinkosky, Marietta, Pa.

[73] Assignee: Marietta Millworks, Marietta, Pa.

[21] Appl. No.: 492,648

[22] Filed: Jun. 20, 1995

[51] Int. Cl.[6] ..... E04C 2/00

[52] U.S. Cl. ..... 52/468; 52/506.08; 52/465; 52/506.09; 52/202

[58] Field of Search ..... 52/235, 202, 459–463, 52/465, 468, 471, 506.09, 506.08, 509, 512, 582.1, 586.1, 799.1, 799.14

[56] References Cited

U.S. PATENT DOCUMENTS 764,948 7/1904 Krebs ..... 52/506.08 X
2,312,673 3/1943 Rizzolo ..... 52/506.08
4,212,291 7/1980 Erb ..... 52/465 X
4,736,559 4/1988 Young ..... 52/468 X

*Primary Examiner*—Carl D. Friedman
*Assistant Examiner*—W. Glenn Edwards
*Attorney, Agent, or Firm*—Lowe, Price, LeBlanc & Becker

[57] ABSTRACT

A wall panel system includes various components that permit the wall panel system to be removable in its entirety after installation. The wall panel system is also adjustable to accommodate variations in mounting surface dimensions. Components of the wall panel system include slotted backing boards configured to retain the panels in place, mounting boards and molding caps. Panels of the system are sandwiched between the mounting boards and molding caps and are attached to slotted backing boards and decorative molding for panel securement.

10 Claims, 2 Drawing Sheets

PANEL SYSTEM

FIELD OF THE INVENTION

The present invention is directed to a wall or ceiling panel system and, in particular, to a system which permits easy installation and removal, if desired.

BACKGROUND ART

In the prior art, various types of wall panel systems have been proposed for decorative purposes. U.S. Pat. No. 4,008,549 discloses a panel molding system which is adapted to provide a wide variety of molding combinations for improved wall decor or paneled walls.

Wainscot panel systems are also popular system, these systems providing a unique way of installing decorative raised, flat or embossed modular panels. Typically, these panel systems cover a portion of the wall from the floor upward.

One of the problems with wall panel systems and, in particular Wainscot panel systems, is the need for permanent attachment to a wall surface. With systems requiring permanent installation, it is difficult and undesirable to use such systems in an environment wherein the occupant may be there only temporarily. For example, an apartment dweller would be unlikely to permanently install a wall panel system since it would remain in the apartment after the dweller left. Removal of the systems could also cause wall damage which may have to be paid for by the apartment dweller upon terminating the lease.

In view of these drawbacks, the present invention provides a wall panel system, particularly a Wainscot wall panel system, which is easily installed and removed so that it is adaptable for use in any location.

SUMMARY OF THE INVENTION

Accordingly, it is a first object of the present invention to provide a wall panel system which can given an upscale look to apartments, offices and homes. It is another object of the present invention to provide a panel system which can be easily removed from one location and reinstalled at another location with minimal damage to walls or ceilings and the panel system itself.

A further object of the present invention is to provide a panel system and method of installation which allows for variances in wall or ceiling dimensions which may conflict with standard panel sizes.

Other objects and advantages of the present invention will become apparent as a description thereof proceeds.

In satisfaction of the foregoing objects and advantages, the present invention provides a wall or ceiling panel system comprising: a plurality of panels of defined thickness and a plurality of mounting strips, each mounting strip having a rear attaching face with an adhesive thereon for attachment to a wall or ceiling surface.

The system also includes a plurality of molding caps, each molding cap sized to cover opposing longitudinal ends of adjacent panels when positioned adjacent a wall surface; and a plurality of fasteners, each sized to extend through the molding cap and a space between opposing ends of the adjacent panels and into the mounting strip without penetrating the surface.

The mounting strips with the panels secured thereto by the molding caps can be removed from the surface as a single paneling unit.

The system can also include at least two slotted backing boards, one for a top edge of the panels and the other for a bottom edge of the panels, each slotted backing board having a rear face with an adhesive thereon for attachment to the wall surface. Each backing boards also has a front face to receive a cover molding, and a panel edge receiving recess in the front face, the panel edge receiving recess including a lip portion sized to retain an edge of a panel when positioned in the panel edge receiving recess. When the cover molding is attached to said slotted backing boards, the slotted backing boards and cover moldings are removable with said panels, said molding caps and said molding strips as said single paneling unit.

In the method aspect of the invention describes installing a paneling system comprising the steps of removably attaching a plurality of mounting strips to a surface in a spaced apart relationship and attaching a plurality of slotted backing boards to the surface in a spaced apart relationship. Each of slotted backing boards attached generally perpendicularly to the plurality of mounting strips, each slotted backing board having a rear face with an adhesive thereon for attachment to the surface. Each board also include a front face to receive a cover molding and a panel edge receiving recess in the front face, the panel edge receiving recess including a lip portion sized to retain an edge of a panel when positioned in said panel edge receiving portion.

Further method steps include the attaching of a plurality of panels to the slotted backing boards by insertion of an edge of each panel into a respective panel edge receiving recess and removably attaching a molding cap to each mounting strip to cover a joint between adjacent panels to form a unit comprising the mounting strips, the panels, the slotted backing boards and the molding caps, wherein the entire panel unit can be removed from the surface for placement on another surface.

BRIEF DESCRIPTION OF DRAWINGS

Reference is now made to the drawings of the invention wherein.

DESCRIPTION OF THE PREFERRED EMBODIMENTS

Figure 1:
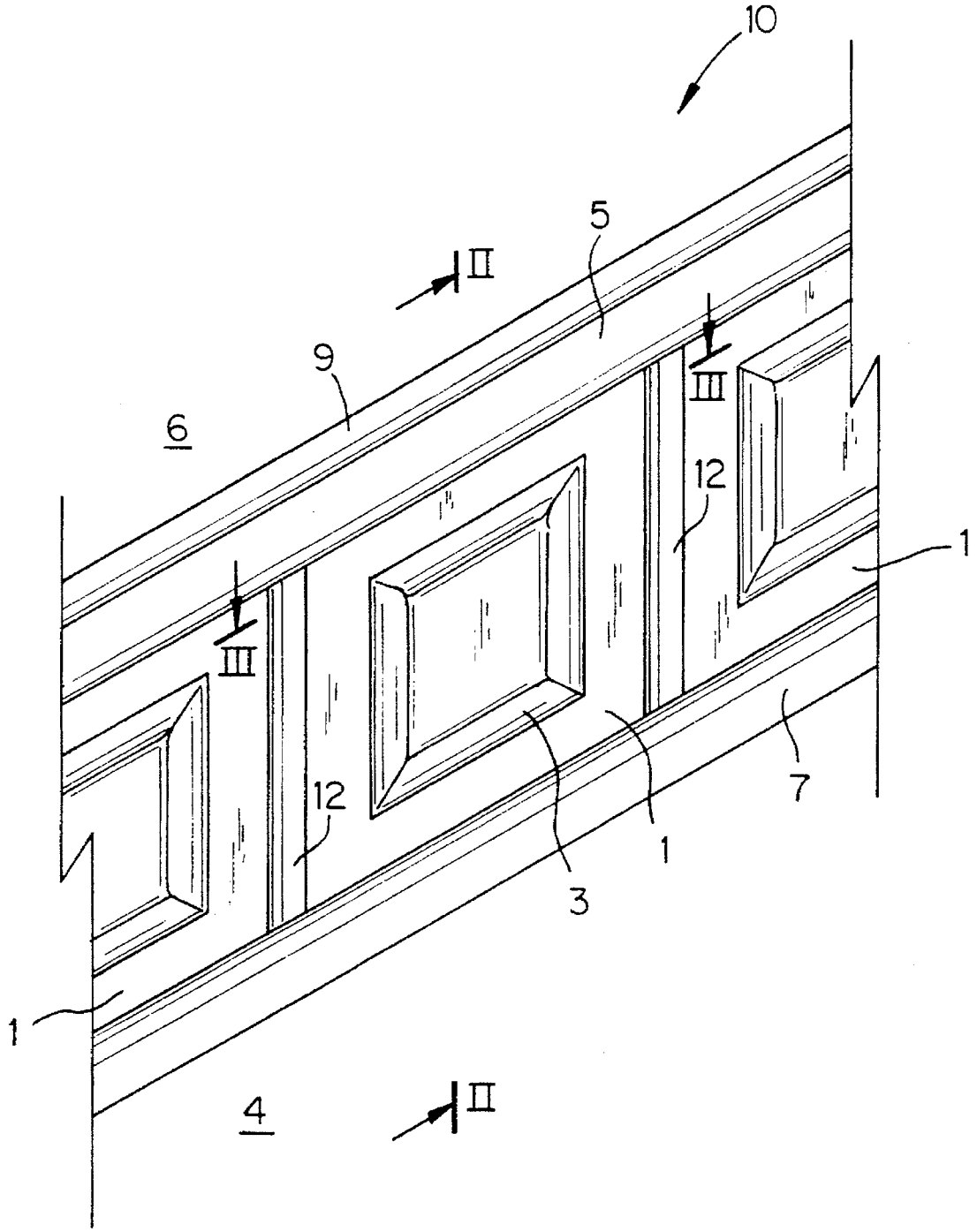
FIG. 1 is a perspective view of one embodiment of the inventive panel system.

With reference to FIG. 1, an exemplary inventive panel system for wall attachment is generally designated by the reference numeral 10. The wall panel system 10 includes a plurality of wall panels 1, each panel including a recessed portion 3. It should be understood that the wall panels 1 can be any design, including flat, raised, embossed or the like rather than the illustrated recessed type.

The panel system 10 is shown abutting the floor 4 and against the wall 6. A decorative top molding 5 extends along the top of the system 10. A bottom molding 7 similar in shape to the top molding 5 extends along the bottom of the system 10 in abutting relationship with the floor 4.

When the wall system 10 extends only part way up a wall surface, a top molding 9 can be attached thereto. Alternatively, if the wall panel system is designed to cover the entire wall from floor to ceiling, the top molding 9 would not be used.

A plurality of molding caps 11 are provided, each molding cap 11 extending between the top and bottom moldings 17 and 7, respectively. Each molding cap 11 also covers a joint (not shown) between opposing edges of adjacent panels 1.

Figure 4:
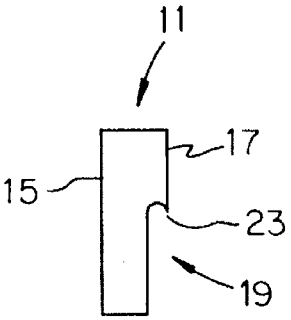
Figure 2:
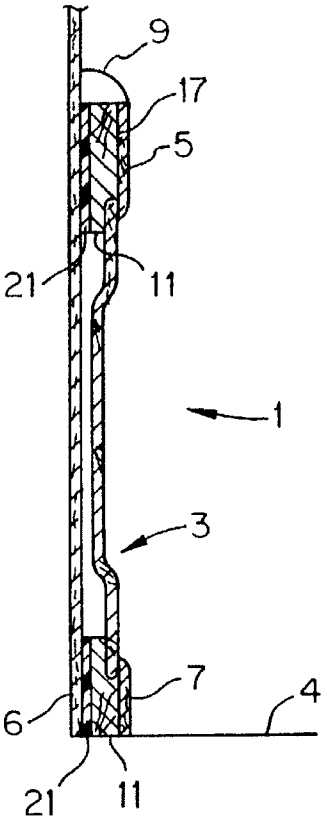
FIG. 2 is a cross-sectional view along a line II—III in FIG. 1.

With reference now to FIGS. 2 and 4 the inventive wall panel system 10 also includes slotted backing boards 11 which are designed to be attached to the wall 6 and retain the wall panels 1 in place.

The slotted backing boards 11 include a rear face 15, a molding receiving face 17 and a slotted portion 19. The rear face 15 is designed to be attached to the wall surface 6. Preferably, double sided tape 21 is used so that the tape can be first applied to the surface 15 and then applied to the wall 6. Of course, the reverse order could also be used for installing the backing boards. Other means for securing the boards 11 to a wall can also be utilized as are known in the art.

The slotted portion 19 includes a lip 23. The slotted portion 19 is sized to receive a terminal end of the panel 1 with the lip 23 acting as a retainer to keep the panel 1 in place for further installation.

Once the backing boards 11 are attached to the wall and the panels 1 secured thereto, the top and bottom moldings 5 and 7, respectively, can be attached to the backing boards at face 17. The moldings 5 and 7 can be attached to the backing boards in any conventional fashion such as using adhesives or fasteners. It is preferred when using fasteners that the fasteners only penetrate into the backing boards 11 and not into the wall surface 6. With fasteners of this size, the backing boards 11 can be removed from the wall surface with the panel system intact for use in another location.

Figure 3:
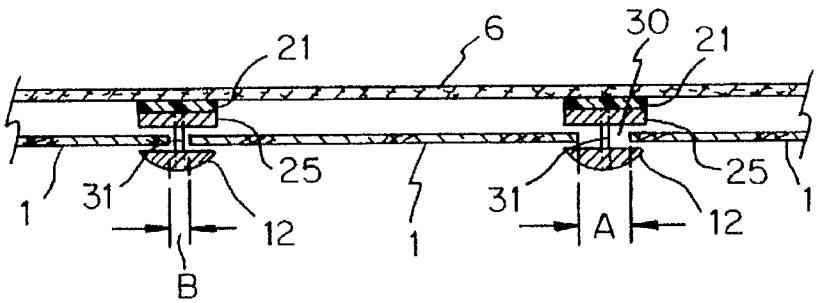
FIG. 3 is a cross-sectional view along the line III—III of FIG. 1.

Referring now to FIG. 3, the wall panel system also includes a plurality of mounting boards 25 which are attached to the wall 6 in the same manner as the slotted backing boards 11. In FIG. 3, a double sided tape 21 is shown for attachment purposes.

When installing the wall panel system, the mounting boards 25 are attached to the wall surface 6 either before or after the slotted backing boards 11 are attached thereto. Once the slotted backing boards 11 and mounting boards 25 are secured, the panels 1 are disposed in the slots 19. Once the panels are installed, the molding caps 12 are attached as are the top and bottom moldings 5 and 7.

The molding caps 12 are designed to cover the joint 30 between adjacent panels 1. Although the molding caps could be fastened to both the mounting plate 25 and wall 6, it is preferred that the molding caps 12 only be fastened to the mounting boards 25 to allow removability of the wall system as described above with respect to the slotted backing boards 11.

When attaching the molding caps 12, it is preferable to use fasteners 31 which are sized to extend only into the mounting boards 25 and not into the wall 6. This again facilitates removal of the entire wall panel system 10 without damaging the wall 6. The molding caps 12 when fastened to the mounting boards 25 secure the panels 1 in place in a similar manner as the attachment of the top and bottom moldings 5 and 7 to the slotted backing boards 11. With the top and bottom moldings and molding caps attached, the entire wall panel system can be removed from a wall 6 and installed in a different location by merely replacing the attachment means, for example, removing the old tape 21 applying a new double sided adhesive when necessary.

The use of the mounting boards 25 and molding caps 12 also permit the inventive wall paneling system to accommodate widths of a wall which may not exactly correspond to the cumulative width of the number of panels used. For example, if a room has a wall width of eight feet, three and one half inches, and each panel is twelve inches in width, eight panels in close abutting relationship would be insufficient to cover the wall. Nine panels would be too many. However, with the inventive wall panel system, the distance between adjacent panels can be varied.

With reference again to FIG. 3, one joint between adjacent panels 1 shows a joint width between opposing edges of the panels as "B". The other joint width is represented by the letter "A". As is evident from FIG. 3, the distance between adjacent panels can be varied to accommodate variances in the overall wall width.

In the example above, the excess wall width of three and one half inches over the cumulative wall width can be covered by merely adjusting the width between adjacent panels. In this manner, the inventive wall panel system can accommodate wall widths which may not exactly correspond to the overall panel widths. Moreover, the inventive wall system is flexible in that the distance between adjacent panels can slightly vary across the wall width while still covering the entire wall surface. For example, if eight panels are used and three and one half inches of extra wall space must be covered, each joint width could be 0.4375 inches. Alternatively, some joints could be larger and some smaller, the overall cumulative spacing still equaling three and one half inches. Thus, the mounting boards 25 do not have to be mounted with precise accuracy or, in other words, on centers corresponding to the width of the panels 1.

As stated above, the inventive wall system can be installed by first attaching the slotted backing boards 11 and mounting boards 25 in any sequential fashion. A preferable installation method would include first attaching the bottom slotted backing board followed by spacing and attaching of the mounting boards 25 since they could rest on the top surface of the first attached slotted backing board 11. The top slotted backing board 11 could then be attached to the wall while simultaneously resting on the mounting boards which would be sized to extend between the top and bottom slotted backing boards. Of course, the mounting boards 25 could be shorter in length, if desired.

Once the slotted backing boards and mounting boards are attached, the panels could be installed followed by attachment of the top and bottom moldings and the molding caps. The thickness of the backing boards can also vary depending on the type of panel used. If panels having raised portions are used, thinner backing boards could be used since space is not required to accommodate the recessed portion.

While the various components of the inventive wall panel system are shown as being made of wood, any material could be used, including a metallic or non-metallic material for all or some of the components. The top and bottom moldings 7 are shown as exemplary moldings and other configurations could be used. Likewise, the molding caps 12 could also be of a different cross-sectional shape than that shown in FIG. 3.

The inventive wall system and method of installation offers a convenient and easy way to put up a wall panel system. In addition, the inventive wall panel system can be easily removed by using an adhesive such as a double sided tape or a removable adhesive so that the system can be removed and installed in another location. The inventive wall panel system also allows adjustment across the width of a given room wall by having the ability to adjust the distance between adjoining panels.

It should be understood that the panel system 10 of FIG. 1 is also adaptable for any surfaces such as ceilings or the like.

As such, an invention has been disclosed in terms of preferred embodiments thereof which fulfill each and every one of the objects of the present invention as set forth hereinabove and provides a new and improved wall panel system and method of installation.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A removable paneling system comprising:

a) a plurality of panels of defined thickness, each panel having an outer surface and opposing longitudinal ends;

b) a plurality of mounting strips, each mounting strip having front face and a rear attaching face with an adhesive thereon for attachment to a surface;

c) a plurality of molding caps, each molding cap having a flat bottom portion sized to rest against opposing edge outer surface portions of adjacent panels and to cover opposing longitudinal ends of adjacent panels when positioned adjacent said surface;

d) a plurality of fasteners, each fastener sized to extend through said molding cap and a space between the flat bottom portion of said molding cap and the front face of the mounting strip and into said mounting strip without penetrating said surface; and e) wherein said mounting strips with said panels secured thereto by said molding caps can be removed from said surface as said removable paneling unit.

2. A removable paneling system comprising a) a plurality of panels of defined thickness each panel having an outer surface and opposing longitudinal ends;

b) a plurality of mounting strips, each mounting strip having a front face and a rear attaching face with an adhesive thereon for attachment to a surface;

c) a plurality of molding caps, each molding cap having a flat bottom portion sized to rest against opposing edge outer surface portions of adjacent panels and to cover opposing longitudinal ends of adjacent panels when positioned adjacent said surface;

d) a plurality of fasteners, each fastener sized to extend through said molding cap and a space between the flat bottom portion of said molding cap and the front face of the mounting strip and into said mounting strip without penetrating said surface; and e) at least two slotted backing boards, one for a top edge of said panels and the other for a bottom edge of said panels, each slotted backing board having a rear face with an adhesive thereon for attachment to said surface, a front face to receive a cover molding, and a panel edge receiving recess in said front face, said panel edge receiving recess including a lip portion sized to retain an edge of a panel when positioned in said panel edge receiving recess, wherein, when said cover molding is attached to said slotted backing boards, said slotted backing boards and cover moldings are removable with said panels, said molding caps and said molding strips as a removable paneling unit.

3. The removable paneling system of claim 1, wherein said adhesive further comprises double sided adhesive tape.

4. The removable paneling system of claim 2, wherein said adhesive further comprises double sided adhesive tape.

5. The removable paneling system of claim 1, wherein each said molding cap is sized to allow for a gap between said opposing longitudinal edges and cover a portion of each opposing longitudinal edge so that each said gap can be varied so that said panels can be positioned to cover said surface.

6. A method of installing a paneling system comprising the steps of:

a) removably attaching a back face of a plurality of mounting strips to a surface in a spaced apart relationship;

b) attaching a plurality of slotted backing boards to said surface in a spaced apart relationship, said slotted backing boards attached generally perpendicularly to said plurality of mounting strips, each said slotted backing board having a rear face with an adhesive thereon for attachment to said surface, a front face to receive a cover molding, and a panel edge receiving recess in said front face, said panel edge receiving recess including a lip portion sized to retain an edge of a panel when positioned in said panel edge receiving portion;

c) attaching a plurality of panels to said slotted backing boards by insertion of an edge of each said panel into a respective said panel edge receiving recess; and d) removably attaching a molding cap to each said mounting strip to cover a joint between adjacent panels to form a panel unit comprising said mounting strips, each molding cap having a flat bottom which rests against opposing edge outer surfaces of adjacent panels to create a space between the flat bottom and a front face of the mounting strip which permits a plurality of different spacings between opposing longitudinal ends of adjacent panels in said paneling system;

e) wherein said entire panel unit can be removed from said surface for placement on another surface.

7. The method of claim 6, wherein said removably attaching steps further comprising applying a double side adhesive tape to a surface of each of said mounting strip, and slotted backing boards for attachment to said surface.

8. The method of claim 6, wherein each said molding caps is attached using at least one fastener sized to penetrate said mounting strip without penetrating said surface.

9. The method of claim 6, wherein said panels are installed with a varying gap between adjacent panels to accommodate a width greater than a cumulative width of said panels.

10. The method of claim 6, wherein said surface is one of a wall surface or a ceiling.

* * * * *